US008512088B2

(12) United States Patent
Jone et al.

(10) Patent No.: US 8,512,088 B2
(45) Date of Patent: Aug. 20, 2013

(54) BUOY

(75) Inventors: Timothy Mealle Jone, Fareham (GB); Timothy James Whitten, Bristol (GB)

(73) Assignee: Babcock Integrated Technology Limited, London (GB)

( * ) Notice: Subject to any disclaimer, the term of this patent is extended or adjusted under 35 U.S.C. 154(b) by 277 days.

(21) Appl. No.: 12/920,259

(22) PCT Filed: Feb. 27, 2009

(86) PCT No.: PCT/GB2009/000567

§ 371 (c)(1),
(2), (4) Date: Aug. 30, 2010

(87) PCT Pub. No.: WO2009/106853

PCT Pub. Date: Sep. 3, 2009

(65) Prior Publication Data

US 2011/0000417 A1 Jan. 6, 2011

(30) Foreign Application Priority Data

Feb. 29, 2008 (GB) ..... 0803834.1

(51) Int. Cl.
*B63B 22/18* (2006.01)
*B63G 8/40* (2006.01)

(52) U.S. Cl.
USPC ..... 441/21; 114/328

(58) Field of Classification Search
USPC ..... 441/1, 2, 21, 23, 28, 29; 114/328
See application file for complete search history.

(56) References Cited

U.S. PATENT DOCUMENTS 1,556,057 A 6/1923 Wheller
2,224,650 A * 12/1940 Holloway ..... 446/161

(Continued)

FOREIGN PATENT DOCUMENTS

GB 114481 4/1918
GB 2335888 A 6/1999

(Continued)

OTHER PUBLICATIONS

International Search Report and Written Opinion issued in related PCT Patent Application Serial No. PCT/GB2009/000567, Apr. 19, 2010, 8 pages.

(Continued)

*Primary Examiner* — Lars A Olson
*Assistant Examiner* — Anthony Wiest
(74) *Attorney, Agent, or Firm* — Lathrop & Gage LLP

(57) ABSTRACT

A buoy (1) has a main body (5) and a moveable mass (2) positioned inside the main body. The buoy may be tethered to a submarine vessel and used as a communications buoy. The buoy may be configured for floating in a generally upright orientation at the water surface (7) in a position ready for communication, when the mass (2) is in a first position (FIG. 1*a*) in which the center of mass is offset from the center of buoyancy to improve stability in the water. The buoy may be configured for being towed underwater at speed, when the mass is in a second position (FIG. 1*b*), in which the center of mass is closer to the center of buoyancy, to improve towing stability in the water, thereby allowing the buoy to be towed with its long axis substantially aligned with the direction of motion, thereby reducing wake/plume in the water.

22 Claims, 3 Drawing Sheets

(56) References Cited

U.S. PATENT DOCUMENTS

| | | | | |
|---|---|---|---|---|
| 2,586,828 | A | 2/1952 | Keeran | |
| 3,374,494 | A | 3/1968 | Hunley | |
| 3,972,046 | A | 7/1976 | Lombardi | |
| 3,972,047 | A | 7/1976 | Lombardi | |
| 4,947,782 | A | 8/1990 | Takahashi | |
| 4,964,356 | A | 10/1990 | Sullivan et al. | |
| 5,018,472 | A | 5/1991 | Sullivan et al. | |
| 5,319,376 | A * | 6/1994 | Eninger | 342/357.4 |
| 5,460,556 | A | 10/1995 | Logan et al. | |
| 5,748,102 | A | 5/1998 | Barron | |
| 6,058,874 | A | 5/2000 | Glenning et al. | |
| 6,183,326 | B1 * | 2/2001 | Stein et al. | 441/21 |
| 6,807,856 | B1 | 10/2004 | Webb | |
| 7,559,288 | B2 * | 7/2009 | Amidon | 114/328 |
| 7,900,571 | B2 * | 3/2011 | Jaber et al. | 114/245 |
| 2003/0000448 | A1 | 1/2003 | Kruger et al. | |
| 2003/0068935 | A1 | 4/2003 | Dubois | |
| 2008/0029015 | A1 | 2/2008 | Amidon | |
| 2008/0132130 | A1 | 6/2008 | Nigel | |

FOREIGN PATENT DOCUMENTS

| | | | |
|---|---|---|---|
| WO | 2005120942 | A1 | 12/2005 |
| WO | 2005120943 | A1 | 12/2005 |
| WO | 2007045864 | A1 | 4/2007 |

OTHER PUBLICATIONS

Jaber, et al. "Recoverable Tethered Optical Fibre Submarine Communications" UDT Conference Nice 2004, 7 pages.

International Preliminary Report on Patentability issued in related PCT Patent Application Serial No. PCT/GB2009/000567, dated Sep. 10, 2010.

* cited by examiner

BUOY

BACKGROUND OF THE INVENTION

The present invention concerns a buoy. More particularly, but not exclusively, this invention concerns a tethered communications buoy for use with a submarine vessel. The invention also concerns a method of recovering a tethered buoy.

The integration of submarine vessels into naval surface operations has been limited by the lack of reliable high-bandwidth data communications systems. Such communications systems should preferably not affect the submarine's primary attribute of stealth, and should preferably be available at speed and depth and without limiting the maneuverability or performance of the submarine vessel.

Proposals for communication systems for a submarine include the use of a tethered communications buoy system. Some of those systems operate by deploying and recovering a communications buoy from a submerged submarine via a tether line, which may for example include a fibre optic cable. Towed buoy systems can generate surface wake potentially risking detection of the location of the submarine. A solution to this problem is to have different modes of operation including a surface mode in which the buoy floats in the water and communicates (in which mode the buoy is not towed by the submarine) and a second travelling mode in which the buoy is recovered by the submarine.

In a communications buoy system such as that described above, the buoy may be released from the submarine so that it rises to the surface under its own buoyancy, surfacing with low surface disturbance (wake or plume) to reduce the probability of detection. At the surface, the buoy may be engaged in communication during a "communications window". During surface operations, the buoy is allowed to float on the surface whilst a tether line is continually deployed at very low tension from a winch on the submarine. When the communications window is concluded, the buoy system is recovered to the submarine by reversing the winch and reeling the buoy back in so that it travels beneath the water surface. Buoys suitable for this purpose are disclosed in WO 2005/120942, WO 2005/120943, and WO 2007/045864.

Communications buoys tend to suffer from various problems, some of which will now be described.

Buoys designed to operate directly below the surface suffer from low data rates. Thus, a communications buoy may include an antenna for receiving/transmitting data, the antenna being positioned at the upper end of the buoy so that the antenna is exposed and is above the water line when the buoy is floating at the water surface. However, in rough waters there may be interruptions to the communications window caused as a result of water washing over the antenna.

A buoy which is designed so that it floats in a stable and generally upright manner at the surface of the water generally has a shape and/or mass distribution such that it is not very well suited to travelling in a streamlined fashion through water. Also, it may be desirable for the buoy to travel at speed through the water without generating forces which cause the buoy to deviate from a desired path. For example, if the buoy has a tendency to rise in the water when being towed in a generally horizontal direction, the buoy might surface causing highly visible wake and plume on the water surface. On the other hand, if the buoy flies too low in the water (has a tendency to sink when towed at speed), the tether line used to tow the buoy may get too close to the propulsion unit at the rear of the submarine vessel. Various solutions have been proposed to these problems.

WO 2005/120492 describes a buoy having a stabilising tail and a yoke connected at one end to a tether line and pivotally connected at the other to the centre of buoyancy of the buoy. WO 2005/120943 discloses a buoy having a tail moveable between a closed position which minimises drag when the buoy travels through water and an open position in which the centre of mass is moved relative to the centre of buoyancy thus facilitating a stable floating configuration. The buoy of WO 2005/120943 also includes a pivotally moveable arm for lifting an antenna clear of the water. Both WO 2005/120942 and WO 2005/120943 have the disadvantage of having externally mounted moving parts of a complicated design and which might result in an undesirably large wake/plume at certain speeds/orientations of travel.

WO 2007/045864 discloses a buoy having fixed hydrodynamic surfaces for increasing the stability of the buoy when towed at certain speeds. The buoy must however travel at certain speeds to be stable in the water. The buoy has a tendency to rise (or sink) to varying degrees in the water, depending on the speed at which it is being towed in the horizontal direction.

The present invention seeks to mitigate the above-mentioned problems. Alternatively or additionally, the present invention seeks to provide an improved buoy.

SUMMARY OF THE INVENTION

According to a first aspect of the present invention, there is provided a buoy having a main body, and a moveable mass positioned inside the main body, the mass being moveable between a first position in which the centre of mass of the buoy is offset from the centre of buoyancy of the buoy and a second position in which the centre of mass is closer to the centre of buoyancy.

The buoy may thus be used as a communications buoy having two distinct modes of operation: a first mode when the buoy is configured for floating in a generally upright orientation at the water surface in a position ready for communication, when the mass is in the first position to improve stability in the water; and a second mode when the buoy is configured for being towed underwater at speed, when the mass is in the second position to improve towing stability in the water. For example, in the first mode of operation the centre of mass may be positioned significantly lower than the centre of buoyancy thereby urging the buoy into an upright orientation in the water, whereas in the second mode of operation, the centre of mass may be positioned in substantially the same position as the centre of buoyancy. This may thereby allow an elongate buoy to be towed in the water with its long axis substantially aligned with the direction of motion, thereby reducing wake/plume, in the water. The buoy may also be configured such that it can be towed in the water at varying speeds without causing any significant change in the tendency of the buoy to rise or sink in the water. This can assist in towing the buoy back to a submarine vessel accurately along a desired path.

It will be appreciated that the centre of buoyancy of the buoy may not be fixed and may depend on the mass of the buoy and the orientation and position of the buoy in a body of water. Thus, the buoy is preferably configured so that the centre of mass of the buoy may be controllably shifted by a distance greater than the distance by which the centre of buoyancy might change as between the free-floating and submerged states of the buoy. The buoy may be so arranged that the centre of mass of the buoy is controllably moveable by a distance greater than 10% of the length of the buoy, and preferably by a distance greater than 20% of the length of the buoy. The centre of buoyancy of the buoy may be in the region of the centre of the buoy.

The moveable mass may at least partly be defined by redundant mass. The redundant mass may for example perform no function other than being moveable ballast for the buoy. Alternatively, or additionally, the moveable mass may comprise apparatus arranged to perform a function different from and in addition to providing part of the mass of the moveable mass. For example, the moveable mass may comprise a battery. The moveable mass may be at least partly defined by telecommunications equipment. The majority by mass of the moveable mass is preferably solid. The moveable mass preferably has a mass of greater than 1 Kg. The moveable mass may have a mass of greater than 5 Kg. The moveable mass preferably has a mass greater than 10% of the total mass of the buoy when configured for floating at the water surface. The dry weight of the buoy may be greater than 20 Kg.

The moveable mass may be arranged for rotational movement between the first and second positions, but in view of the likely shape of the buoy and the desired extreme positions of the moveable mass inside the buoy it may be preferred for the moveable mass to be arranged for linear movement only between the first and second positions. Such linear movement is preferably in a direction along the length of the buoy. The distance between the first and second positions is preferably greater than 20% of the length of the buoy. The distance between the first and second positions is preferably greater than 100 mm and may be greater than 250 mm.

The buoy is preferably elongate in shape. The buoy may have a generally round cross-section. The buoy may have a length measured along a longitudinal axis, with the buoy being arranged such that the longitudinal axis is generally vertical when the buoy floats at the water surface. The length of the buoy may be greater than 1 m. The length of the buoy may be less than 2 m. The ratio of the maximum diameter of the main body of the buoy (i.e. excluding external fins, wings, or the like) to the length of the main body of the buoy is preferably less than 25% and more preferably less than 20%. Thus, the diameter of the main body of the buoy at its widest point is preferably less than 20% of the length of the main body of the buoy. When determining the length or diameter of the main body of the buoy, the dimensions should be measured when the buoy is configured for moving underwater.

The present invention has particular application in relation to a communications buoy. Thus, the buoy may for example include a communications antenna. The antenna may be mounted at an upper end of the buoy. It will be appreciated that the upper end of the buoy includes more than just the extreme end of the buoy. The antenna may be mounted for linear movement. The antenna may be mounted for movement between a retracted position and an extended position, in which the antenna is raised (or projects) above the main body of the buoy. The buoy may be configured such that when the antenna is in the extended position, there is defined a waisted region between the lower end of the antenna and the upper end of the main body of the buoy. Such a waisted region may assist in reducing water washing over the antenna as is explained in further detail below.

It will of course be appreciated that the buoy of the present invention may have applications other than as a communications buoy. For example, the buoy could be used as a surveillance buoy. The buoy may include sensing equipment mounted at its upper end (when the buoy is floating at the water surface). Such sensing equipment may include a camera. The equipment mounted at the upper end of the buoy may be removably mounted to allow different equipment to be installed for use in different applications for the buoy. For example, a different antenna may need to be used for different purposes. The buoy including a first items of electronics equipment removably mounted at the upper end of the buoy may form part of a kit of parts including at least one further item of removably mountable electronics equipment for performing a function different from the first item. The first items of electronics equipment may comprise an antenna. The further items of electronics equipment may comprise an antenna.

The moveable mass may be mounted such that it moves in response to the orientation of, or forces acting on, the buoy. Preferably, however, the buoy includes means for moving the moveable mass, such as a prime mover. The means for moving the moveable mass may, for example, comprise an electric motor. The means for moving the moveable mass may, for example, comprise a lead screw. The means for moving the moveable mass may, for example, comprise a ram. The means for moving the moveable mass may, for example, comprise a solenoid. The means for moving the moveable mass may, for example, comprise a hydraulic component. The means for moving the moveable mass may comprise a control unit mounted in the buoy. The buoy may include electronic equipment, such as a communications antenna, mounted at an upper end of the buoy which is moveable by the same means as provided for moving the moveable mass.

An upper end of the buoy may have a waisted region. The buoy and the waisted region are preferably so arranged that that the waisted region acts, in use when the buoy is floating at the water surface and electronic equipment is operating at the upper end of the buoy, to increase the protection of such electronic equipment from water washing over the upper surface of the upper end of the buoy. For example, the waisted region may be shaped so as to divert or deflect water that might otherwise simply wash over the top of the buoy. The waisted region may be positioned such that, when the buoy is floating in water, the upper end of the waisted region is above the water line of the buoy.

The waisted region preferably has a shape that, with increasing distance along the length of the buoy (from bottom to top when in the floating position), decreases from a first diameter to a second diameter and then increases to a third diameter. The second diameter may be the minimum diameter of the waisted region. The third diameter may be the maximum diameter of the portion of the buoy that extends from the second diameter to the uppermost end of the buoy. The first diameter is preferably more than 10% wider than the second diameter and preferably more than 20% wider than the second diameter. The third diameter is preferably more than 10% wider than the second diameter and preferably more than 20% wider than the second diameter. The first diameter may by larger than the third diameter. The first diameter may be equal to the third diameter. The diameter of the buoy preferably, varies smoothly with distance along the length of the buoy between the first diameter and the third diameter. The part of the buoy having the smallest radius of curvature (at the external surface of the buoy) when viewed in cross-section along its length may be positioned closer to the third diameter than to the first diameter. There may be a lip in the region of the third diameter which acts to reduce the amount of water than splashes or washes over the uppermost end of the buoy. The buoy may be configured so that the waisted region may be formed or revealed in one mode of operation and otherwise removed, changed or hidden.

The buoy may include ballast means that is able to displace water so as to change the location of the centre of buoyancy of the buoy. The ballast means may comprise an expandable gas-filled bladder. The ballast means may be positioned at the upper end of the buoy. The ballast means is preferably positioned inside the buoy and is able to cause ingress of water from outside the buoy, as well as egress of water. For example, contraction of a bladder may cause ingress of water, whereas expansion of the bladder causes egress of water. The volume of gas, and/or the pressure of the gas, in the bladder may be passively or may be actively controlled. A means for actively expanding or contracting the bladder may for example be provided in the form of, one or more of a heater, a pump, and a valve. The ballast means may be removably mounted. The buoy may form part of a kit of parts including at least one further ballast means of a differing capacity (thereby possibly offering a differing amount of possible change in buoyancy when installed in the buoy). For example, a first ballast means having a first maximum buoyancy may be required for a first application, in which the buoy has a first mass, whereas a second ballast means having a second higher maximum buoyancy may be required for a second application, in which the buoy has a second mass which is higher than the first, for example as a result of carrying different (and heavier) payload.

The buoy may comprise a connector port for facilitating optical and mechanical connection to a tether line comprising a fibre optic cable. The connector port may be fixedly positioned at the lower end of the buoy.

The buoy may be a tethered buoy. The buoy may for example be connected to a tether line at a lower end of the buoy. The tether line may comprise fibre optic cable. The tether line may comprise an electric power line, but preferably does not in view of the extra weight and mass that such a power line would contribute to the tether.

It will be appreciated that the present invention may have application in relation to buoys that are not always tethered or towed. For example, the buoy may be arranged after concluding operations at the water surface to sink without being towed or tethered.

The advantages of the waisted region of the buoy of the first aspect of the present invention may have application on a buoy in respect of which there is no moveable mass inside the buoy.

According to a second aspect of the invention, there is provided a communications buoy having a lower end and an upper end, the upper end having a waisted region positioned such that, when the buoy is floating in water in a condition ready to facilitate telecommunication, the upper end of the waisted region is above the water line of the buoy.

The buoy of the second aspect of the invention may have any of the features of the buoy of the first aspect of the invention. In particular, the waisted region may have any of the features of the waisted region of the first aspect of the invention.

The present invention also provides a method of using a buoy. The buoy may be tethered by means of a tether line connected at one end to the buoy and at the other end to a submarine vessel. The buoy may additionally, or alternatively, be a buoy according to either the first or second aspects of the invention. The method may include towing the buoy. The method may include causing the buoy to float in a body of water. The method may include changing the position of the centre of mass of the buoy without changing the external shape of the buoy. For example, the centre of mass of the buoy may be moved closer to the centre of buoyancy. A moveably mounted mass may be moved inside the buoy. The method may include withdrawing the buoy from the surface by means of retrieving, for example reeling-in, a tether line attached to the buoy thereby causing the buoy to travel underwater. During performance of the method, the buoyancy of the buoy need not be changed. Alternatively, the method may include a step of changing the buoyancy of the buoy. During the method, water may enter a region in the buoy previously occupied by a fluid having a lower density, thereby changing the buoyancy, the centre of buoyancy and/or the centre of mass.

During the performance of the method, the buoy may be operated in different modes of operation. For example, there may be a first mode of operation, in which the buoy floats in a generally upright orientation and during which the electronic equipment installed in the upper end of the buoy is operated. For example, the buoy may send and receives data via an antenna at the upper end of the buoy which is held substantially clear of the water. There may be a second mode of operation, during which the buoy is towed underwater via a tether line. The centre of mass of the buoy may be closer to the centre of buoyancy of the buoy during the second mode of operation as compared with the first mode of operation. The second mode of operation may be performed before the first mode. The method may comprise a step of raising an antenna immediately before or during the first mode of operation and may comprise a step of retracting the antenna before commencing the second mode of operation.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figures 1A, 1B:
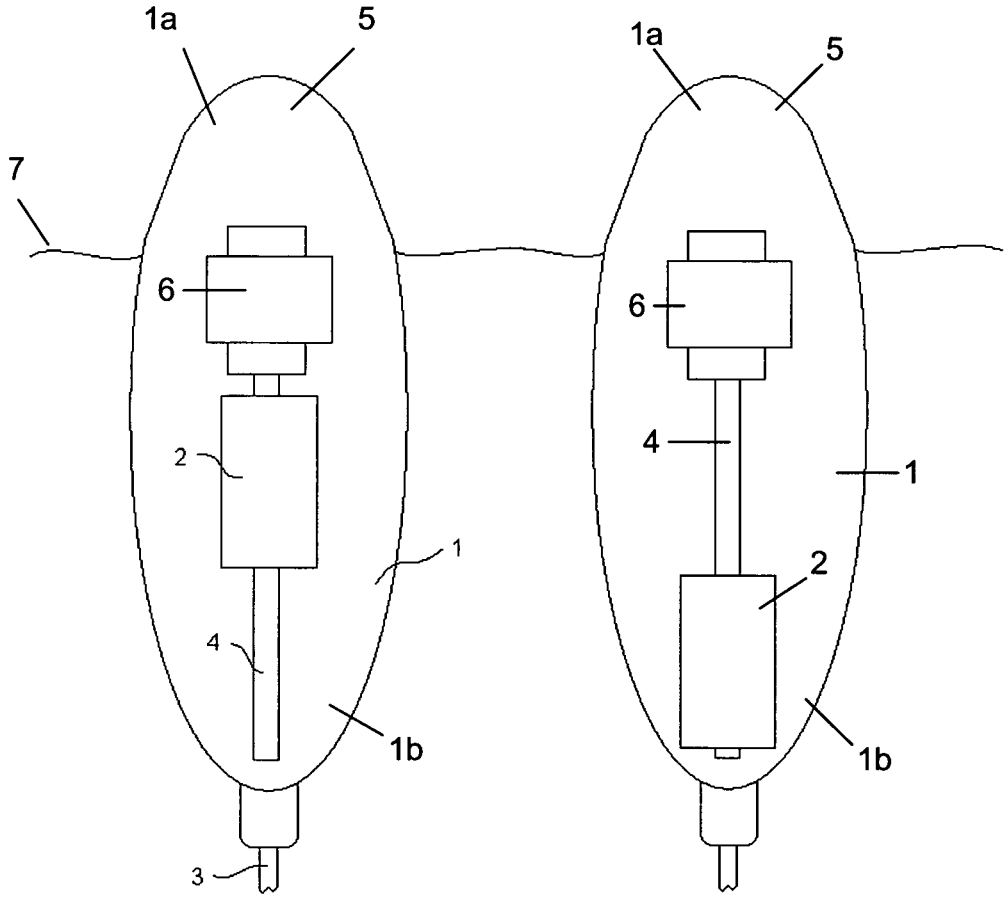
FIG. 1*a* shows a cross-sectional view of a buoy according to a first embodiment of the invention, the buoy being arranged in a towing configuration.
FIG. 1*b* shows a view of the buoy of the first embodiment, but in a floating configuration.

FIGS. 1*a* and 1*b* show as cross-sectional views a buoy 1 according to a first embodiment of the present invention. The buoy 1 has a main body 5 which accommodates various components including communications equipment, batteries and the like. The buoy 1 is shown in FIGS. 1*a* and 1*b* in a floating position, such that the buoy is in a generally upright orientation with an upper end 1*a* containing an antenna (not shown) being supported about a water line 7. Inside the buoy 1 there is located a moveable mass 2 which is movable along a longitudinal screw 4 by means of a motor 6. The mass 2 comprises heavy payload components such as batteries and optical conversion equipment. The mass (dry weight) of the buoy 1 is about 24 Kg and the mass of the moveable mass 2 is about 8 Kg. In a modification of this embodiment, the mass of the buoy is 35 Kg, the moveable mass being about 12 Kg.

The mass 2 is moveable between (i) a first position (shown in FIG. 1*b*), in which the centre of mass of the buoy is off-set from its centre of buoyancy, corresponding to a configuration in which the mass 2 is at a lower end 1*b* of the buoy 1 and (ii) a second position in which the centre of mass of the buoy 1 is closer to the centre of buoyancy, corresponding to the case where the mass 2 is moved closer to the centre of the buoy 1. The distance of movement of the mass 2 between the first and second positions is about 700 mm, which is about 40% of the length of the buoy 1, which acts to shift the centre of mass of the buoy by over 200 mm. In a floating configuration (shown in FIG. 1*b*), the centre of buoyancy is positioned just below the centre of the buoy, whilst the centre of mass of the buoy is positioned lower still, thus providing stability in the floating configuration. On the other hand, the configuration shown in FIG. 1*a* has the centre of mass of the buoy much closer to the centre of buoyancy (which, when the buoy is wholly submerged, is roughly at the centre of the buoy), which enables the buoy to be towed underwater in a controlled manner along a desired towing path with a reduced wake/plume, as a result of increased stability. It will of course be appreciated that the mass 2 may be moved to positions other than the first and second positions. In this embodiment, the mass may be moved to any of an infinite number of positions between the first and second position.

The buoy 1 has a tether line 3 fixed at its lower end 1*b*. The tether line 3 comprises fibre optic cable and attaches to a submarine vessel (not illustrated) allowing the buoy to be towed and also to facilitate communication between the submarine and the communications buoy 1. During a communications window, during which the communications buoy 1 is engaged with communication, the buoy is configured in the configuration shown in FIG. 1*b*. Once the communications are terminated, the moveable mass 2 may be moved up towards the upper end 1*a* of the buoy 1 in a position ready for the buoy to be retrieved and towed back to the submarine by means rapidly reeling in the tether line 3.

Figure 2A:
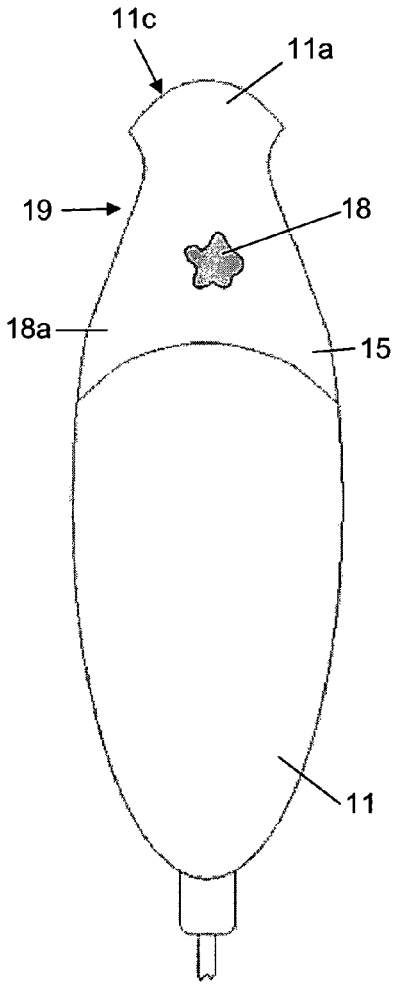
FIG. 2*a* shows a buoy according to a second embodiment, the buoy being arranged in a towing configuration.
Figure 2B:
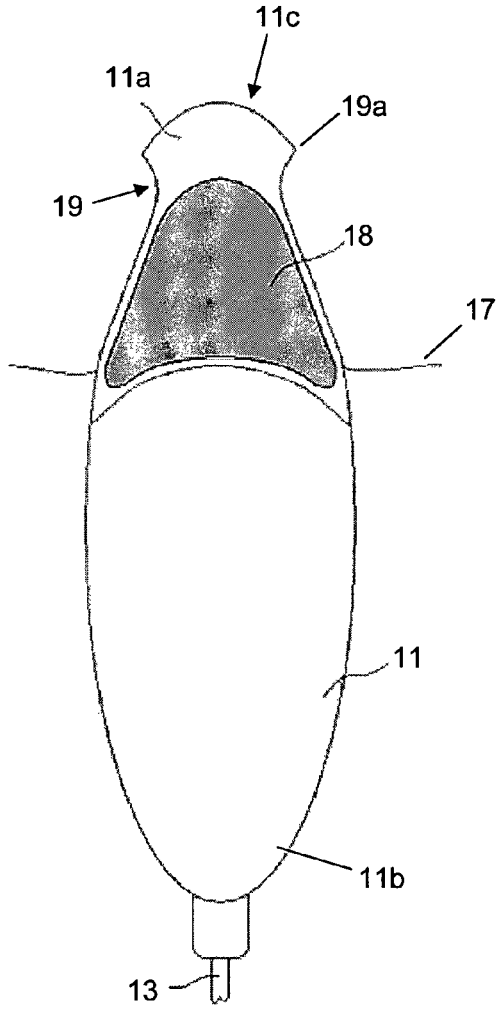
FIG. 2*b* shows the buoy of the second embodiment, but in a floating configuration.

FIGS. 2*a* and 2*b* show a communications buoy 11 in cross-section, according to a second embodiment. The buoy 11 includes a moveable mass system and antenna in the same manner as described with reference to the first embodiment, but these are not shown in FIGS. 2*a* and 2*b*. In the second embodiment, the buoy 1 additionally includes an inflatable bladder 18 (shown schematically in FIGS. 2*a* and 2*b*) accommodated in a chamber 18*a* at an upper end of the buoy. The inflatable bladder 18 has a general shape of a torus, the centre of the torus facilitating connection of an antenna at the upper end 11*a* of the buoy 11. The buoy 11 has a length of about 1.5 meters and a width of about 200 mm. The volume of the chamber 18*a* is about 7 liters.

In FIG. 2*a*, the buoy 11 is shown in a configuration suitable for towing, where the moveable mass (not shown) has been moved closer to the centre of buoyancy and the bladder 18 is in a compressed state. The chamber 18*a* surrounding the bladder 18 is filled with water that passes into the chamber 18*a* by means of a ring of holes (not separately shown) in the main body 15 of the buoy 11 near the interface between the chamber 18*a* and the lower half of the buoy 11. The bladder 18 is sealed but filled with a compressible gas, such as carbon dioxide. When the buoy 11 is underwater water pressure acts to compress the gas in the bladder 18 and facilitates ingress of water into the chamber 18*a*. In the towing configuration the centre of mass of the buoy 11 and the centre of buoyancy of the buoy 11 are both positioned at, or very close to, the centre of the buoy 11. When the buoy is configured in a position ready for floating (as shown in FIG. 2*b*), in which the movable mass has been lowered towards the lower end 11*b* of the buoy, the chamber 18*a* is at atmospheric pressure thereby allowing the bladder 18 to expand, water flowing out of the chamber 18*a* via the holes (not shown) in the main body of the buoy 11. Thus, the inflated bladder 18 further shifts the centre of mass of the buoy lower down the buoy (i.e. lower in the floating configuration, shown in FIG. 2*b*, than in the towing configuration, shown in FIG. 2*a*, in which the mass of water in the chamber 18*a* is significantly increased). In the floating configuration, the mass of the buoy 11 is reduced as compared with the towing configuration and the centre of buoyancy of the buoy 11 moves from the centre of the buoy to a position slightly below the centre of the buoy as a result of the upper end of the buoy 11 protruding out of the water. The centre of mass on the other hand is displaced by a significant distance, and is positioned significantly lower than the centre of buoyancy as a result of both the moveable mass (not shown) being moved downwards and the upper chamber 18*a* emptying of water and filling with air.

The main body 15 of the buoy 11 has a waisted region 19 positioned at the upper end 11*a* of the buoy. When the buoy 11 is floating in the water in a condition ready to facilitate telecommunication (see FIG. 2*b*), the upper end 19*a* of the waisted region 19 is positioned above the waterline 17 of the buoy 11. The waisted region 19 has a shape such that waves and splashing water tend to wash around the buoy 11 beneath the upper end 19*a* of the waisted region 19, rather than wash over the top surface 11*c* of the buoy, which might affect the quality of communications facilitated by the antenna at the upper end 11*a* of the buoy.

In a modification of the second embodiment, the movable mass is fixed and the motor is removed such that the centre of mass of the buoy may be changed only by means of allowing the bladder to expand and contract as previously described.

A further additional or alternative modification to the second embodiment would be to control actively the contraction and expansion of the bladder. For example, a heater could be provided to heat fluid within a reservoir which would expand to fill and expand the bladder as and when required. Pumps or the like could additionally, or alternatively, be used to inflate and/or deflate.

It will be appreciated, that the shape of the buoy 11 of the second embodiment including the waisted region 19 could by itself provide advantages over conventional shapes of communications buoys, irrespective of whether or not the moveable mass, expandable bladder or other ballasting systems are provided.

Figures 3A, 3B:
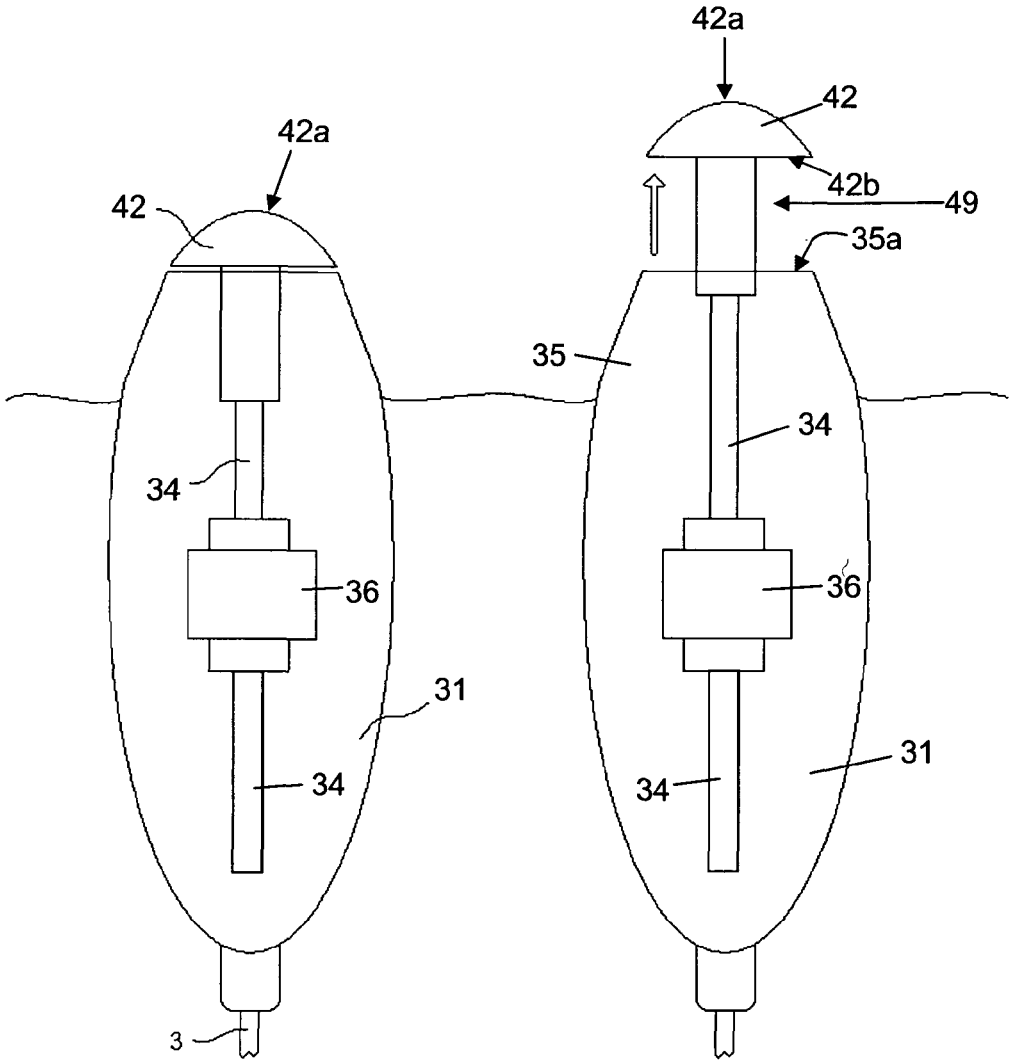
FIG. 3*a* shows a buoy according to a third embodiment with an antenna in a retracted position.
FIG. 3*b* shows the buoy of the third embodiment with the antenna in an extended position.

FIGS. 3*a* and 3*b* show in cross-section a buoy 31 according to a third embodiment. The third embodiment of the invention is similar to the first embodiment, in that a moveable mass (not shown) is provided, which is moveable along a linear screw 34 by means of a motor unit 36. The motor unit 36 is also able to extend and retract an antenna 42. Thus, in the position shown in FIG. 3*b*, the antenna 42 has been raised reducing the chance of waves or water splashing over the upper surface 42*a* of the antenna. Whilst raising the antenna 42 shifts the centre of mass, of the buoy closer to the centre of buoyancy, this can be off-set by lowering the moveable mass (not shown) to the lower end of the buoy 31. Thus, in the configuration shown in FIG. 3*b* the centre of mass of the buoy 31 is significantly lower than the centre of buoyancy and yet the antenna 42 is raised sufficiently above the waterline for reliable communication, whereas in FIG. 3*a* the antenna 42 is retracted but the moveable mass is moved such that the centre of mass is closer to the centre of buoyancy so that the buoy 31 may be towed at speed in a stable manner with reduced wake.

In the floating configuration (shown in FIG. 3*b*) of the buoy 31 of the third embodiment, the region between the lower end

42*b* of the active part of the antenna 42 and the upper end 35*a* of the rest of the main body 35 of the buoy may be considered as a waisted region 49, such that waves and splashing water have a tendency to wash around the waisted region 49 but not above it. It will be appreciated that in this regard, the shape of the main body 35 of the buoy 31 and of the antenna 42 may be adapted to increase the effectiveness of the waisted region 49. For example, the waisted region 49 could be shaped such that in the floating communicating configuration shown in FIG. 3*b* the waisted region 49 has an appearance in shape similar to that of the waisted region 19 of the buoy 11 of the second embodiment. The motor unit 36 controlling movement of the antenna 42 and the moveable mass may be arranged such that a single motor controls both movements simultaneously. Alternatively, the motor unit 36 may be configured to be able to move independently the antenna 42 and the moveable mass.

Instead of moving the moveable mass and/or antenna by means of a motor and lead screw, other mechanical mechanisms could be employed. For example, hydraulic mechanisms could be employed or a solenoid mechanism could be employed.

Whilst the present invention has been described and illustrated with reference to particular embodiments, it will be appreciated by those of ordinary skill in the art that the invention lends itself to many different variations not specifically illustrated herein. It will be appreciated that the modifications and variations described above are given by way of example only.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A recoverable communications buoy for use in a tethered communications buoy system providing communications function to a submerged submarine vessel, wherein:

the buoy has a main body and a communications antenna, the buoy is connected to a tether line, the buoy has a moveable mass positioned inside the main body, the mass being moveable back and forth between a first position in which a centre of mass is offset from a centre of buoyancy of the buoy and a second position in which the centre of mass is closer to the centre of buoyancy, the buoy is operable in a first mode of operation in which the moveable mass is in the first position and in which the buoy floats in a generally upright orientation with an upper end of the buoy being held substantially clear of the water thus enabling the buoy to send and receive data via the communications antenna, and the buoy is operable in a second mode of operation in which the moveable mass is in the second position and in which the buoy is able to be towed underwater and recovered to the submarine by the tether line, the buoy being so configured that when the moveable mass is in the second position and the buoy is towed by the tether line, the long axis of the buoy substantially aligns with the direction of towing motion, to facilitate recovery via the tether line.

2. A communications buoy according to claim 1, wherein the moveable mass is at least partly defined by a battery.

3. A communications buoy according to claim 1, wherein the moveable mass is at least partly defined by telecommunications equipment.

4. A communications buoy according to claim 1, wherein the moveable mass is arranged for linear movement along the length of the buoy.

5. A communications buoy according to claim 1, wherein the communications antenna is mounted at the upper end of the buoy.

6. A communications buoy according to claim 1, wherein the communications antenna is linearly moveable from a retracted position to an extended position, in which the antenna is raised above the main body of the buoy.

7. A communications buoy according to claim 6, wherein when the antenna is in the extended position, there is defined a waisted region between the lower end of the antenna and the upper end of the main body of the buoy.

8. A communications buoy according to claim 7, wherein the waisted region is positioned such that (a) the upper end of the main body of the buoy defines a lower end of the waisted region and a lower surface of an active part of the antenna defines an upper end of the waisted region, and wherein the upper end of the waisted region rides above the water line when the buoy floats in water in the first mode of operation.

9. A communications buoy according to claim 1, wherein the buoy includes, at the upper end, an expandable gas-filled bladder that is able to displace water so as to change the location of the centre of buoyancy of the buoy.

10. A communications buoy according to claim 9, wherein the bladder is positioned inside the buoy and contraction of the bladder allows ingress of water from outside the buoy, whereas expansion of the bladder allows egress of water.

11. A communications buoy according to claim 1, wherein the buoy is connected to the tether line at a lower end of the buoy.

12. A submarine vessel and a communications buoy, wherein the communications buoy is a recoverable communications buoy according to claim 1, the tether line is connected at one end to the buoy and at the other end to the submarine vessel, and the communications buoy provides communications function to the submarine vessel.

13. A method of recovering a buoy which is floating in a body of water and which is tethered by means of a tether line connected at one end to the buoy and at the other end to a submarine vessel, wherein the buoy is a recoverable communications buoy according to claim 1, and the method comprises the steps of:

moving the moveable mass from the first position to the second position;

withdrawing the buoy from the surface by means of retrieving the tether line towards the submarine vessel;

with the moveable mass in the second position, further retrieving the tether line, thereby causing the buoy to travel underwater with its long axis substantially aligned with the direction of motion of the buoy, whereby the buoy is recovered to the submarine for subsequent deployment.

14. A method according to claim 13, comprising the steps of operating the buoy in the first mode of operation, thus causing the buoy to float in a generally upright orientation, and causing the buoy to send and receive data via the communications antenna at the upper end of the buoy which is held substantially clear of the water, and operating the buoy in the second mode of operation while the buoy is towed underwater via the tether line.

15. A method according to claim 14, further comprising the step of raising the antenna immediately before or during the first mode of operation.

16. A communications buoy according to claim 1, further comprising a waisted region formed below an upper end of the buoy, wherein the waisted region is positioned such that, when the buoy is floating in the first mode of operation, an upper end of the waisted region rides above the water line.

17. A communications buoy according to claim 1, wherein the movable mass is selectively moveable to any of a plurality of positions between the first position and the second position.

18. A communications buoy according to claim 1, further comprising an internal motor for moving the moveable mass back and forth between the first and second positions.

19. A communications buoy according to claim 18, further comprising a longitudinal screw within the main body, wherein the moveable mass is movable back and forth along the longitudinal screw via the internal motor.

20. A communications buoy according to claim 1, further comprising means for moving the moveable mass back and forth between the first and second position, the means for moving selected from the group consisting of: a ram, a solenoid, a hydraulic component, and a control unit mounted in the buoy.

21. a communications buoy according to claim 18, the internal motor in communication with the antenna, for controlling extension of the antenna from the main body of the buoy and retraction of the antenna to the main body of the buoy.

22. A communications buoy according to claim 1, the moveable mass being moveable from the second position to the first position, to switch the buoy from the second mode of operation to the first mode of operation and to facilitate redeployment of the buoy after recovery.

* * * * *